United States Patent [19]

Van Erden

[11] Patent Number: 5,002,781

[45] Date of Patent: Mar. 26, 1991

[54] BACON/MEAT PACKAGE

[75] Inventor: Donald L. Van Erden, Wildwood, Ill.

[73] Assignee: Zip-Pak Incorporated, Northbrook, Ill.

[21] Appl. No.: 579,284

[22] Filed: Sep. 7, 1990

Related U.S. Application Data

[63] Continuation of Ser. No. 327,617, Mar. 23, 1989, abandoned.

[51] Int. Cl.[5] ..... B65D 77/10

[52] U.S. Cl. ..... 426/106; 383/61; 383/63; 383/93; 383/95; 426/121; 426/122

[58] Field of Search ..... 383/61, 63, 65, 93; 426/121, 122, 123, 106

[56] References Cited

U.S. PATENT DOCUMENTS

| | | | |
|---|---|---|---|
| 3,339,606 | 9/1967 | Kugler | 383/63 |
| 3,473,589 | 10/1969 | Götz | 206/620 |
| 3,565,147 | 2/1971 | Ausnit | 383/63 |
| 3,780,781 | 12/1973 | Uramoto | 206/620 |
| 3,991,801 | 11/1976 | Ausnit | 383/61 |
| 4,003,184 | 1/1977 | Shio | 426/121 |
| 4,032,492 | 7/1977 | Englund et al. | 524/269 |
| 4,191,230 | 3/1980 | Ausnit | 138/118 |
| 4,532,652 | 7/1985 | Herrington | 383/63 |
| 4,736,451 | 4/1988 | Ausnit | 383/65 |
| 4,923,701 | 5/1990 | VanErden | 383/63 |
| 4,947,525 | 8/1990 | Van Erden | 383/63 |

*Primary Examiner*—Donald E. Czaja
*Assistant Examiner*—Drew S. Workman
*Attorney, Agent, or Firm*—Hill, Van Santen, Steadman & Simpson

[57] ABSTRACT

A flexible plastic film reclosable package for foodstuffs or the like having opposed plastic film walls joined to each other completely around their circumference and having a bag mouth between the walls at one side, fastener strips between the walls in the bag mouth having reclosable pressure interlocking rib and groove profiles joined to close the bag with a peel seal material in the base of the groove to initially hermetically seal the bag and lock the rib in the groove, the fastener strips having outwardly extending base webs to form pull flanges with one of the strips having an inwardly extending base web laminated to the film and either no base web or a very short protective base extending inwardly from the other fastener strip and a protector board inserted in the bag between the profiles and the contents.

5 Claims, 1 Drawing Sheet

10
11
12
13
14
15
15'
16
17
18
18'
19
19'
20
20'
21
21'
22
22'
23
24
25
II

BACON/MEAT PACKAGE

This is a continuation of application Ser. No. 327,617, filed Mar. 23, 1989, now abandoned.

BACKGROUND OF THE INVENTION

This invention relates to improvements in the packaging art, and more particularly to improvements in reclosable bags.

In the provision of reclosable bags, and particularly those which are used for foodstuffs, it is desirable that a structure be used by which the bag is initially fully sealed. When used for general merchandise, this prevents tampering with the contents, and when used for foodstuffs, the initial sealing protects the contents from spoilage and tampering or contamination due to intentional access to the bag or due to the entrance of air or contaminants. It is further desirable that the initial sealing be such that it is not inadvertently opened due to handling of the bag, and if opened, that there is a tamper-evident feature which would show the purchaser that the bag had been previously opened. These objectives must be accomplished without adversely affecting the reclosable feature that is used.

In some arrangements previously used, a sealing means has been provided outside of the reclosable fastener, but these allow an air space between the reclosable structure and the contents. Also, if the bag holds food items, the presence of the food can contaminate or interfere with the reclosable structure. This is particularly true where a fine rib and groove profile type of closure is used which should be kept clear of contaminants which would interfere with the interlocking of the closing structure.

It is accordingly an object of the present invention to provide an improved flexible plastic bag structure which has a closable zipper at the mouth and which is provided with a unique sealing arrangement to prevent contamination of the foodstuffs within the container and prevent the foodstuffs from contacting the reclosable zipper.

A further object of the invention is to provide an improved fastener which is doubly sealed with sealing means outwardly of the reclosable fastener and sealing means inside of the fastener within the bag.

A still further object of the invention is to provide an improved bag and fastener structure which is particularly well suited for containing foodstuffs such as sliced meat, cheeses and other items which must be completely isolated from the outside before using.

FEATURES OF THE INVENTION

The invention utilizes a plastic film bag for containing foodstuffs such as stacked slices of bacon or meat. The plastic film bag is sealed around its edge and has a mouth along one side edge. In the bag mouth is a reclosable zipper. The zipper is formed from opposed fastener strips each having a complementary rib and groove type of interlocking profile. The profiles have base web portions extending outwardly to provide opening pull flanges. One fastener has a portion extending inwardly arranged to be bonded to the film wall of the bag.

The film layers of the bag walls extend beyond the outwardly extending base web portions to seal the bag outwardly of the fastener strip profiles.

An important feature is that a secure hermetic seal is arranged which provides a second seal inwardly of the bonded together layers of film at the mouth of the bag. This additional seal locks the rib and groove profiles together in a tamper-evident manner so that they remain sealed until the user purchases the package and opens it for the first time. After this first opening, the bond is broken and the rib and groove element functions in a normal manner. The bond prevents the entry of contaminants but also prevents the migration of grease or gases from the foodstuff outwardly. The bond is in the form of a peel seal which is relatively rigid so that the rib can be pulled from the groove to break away from the peel seal and thereafter function normally.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figures 1, 2, 3, 4:
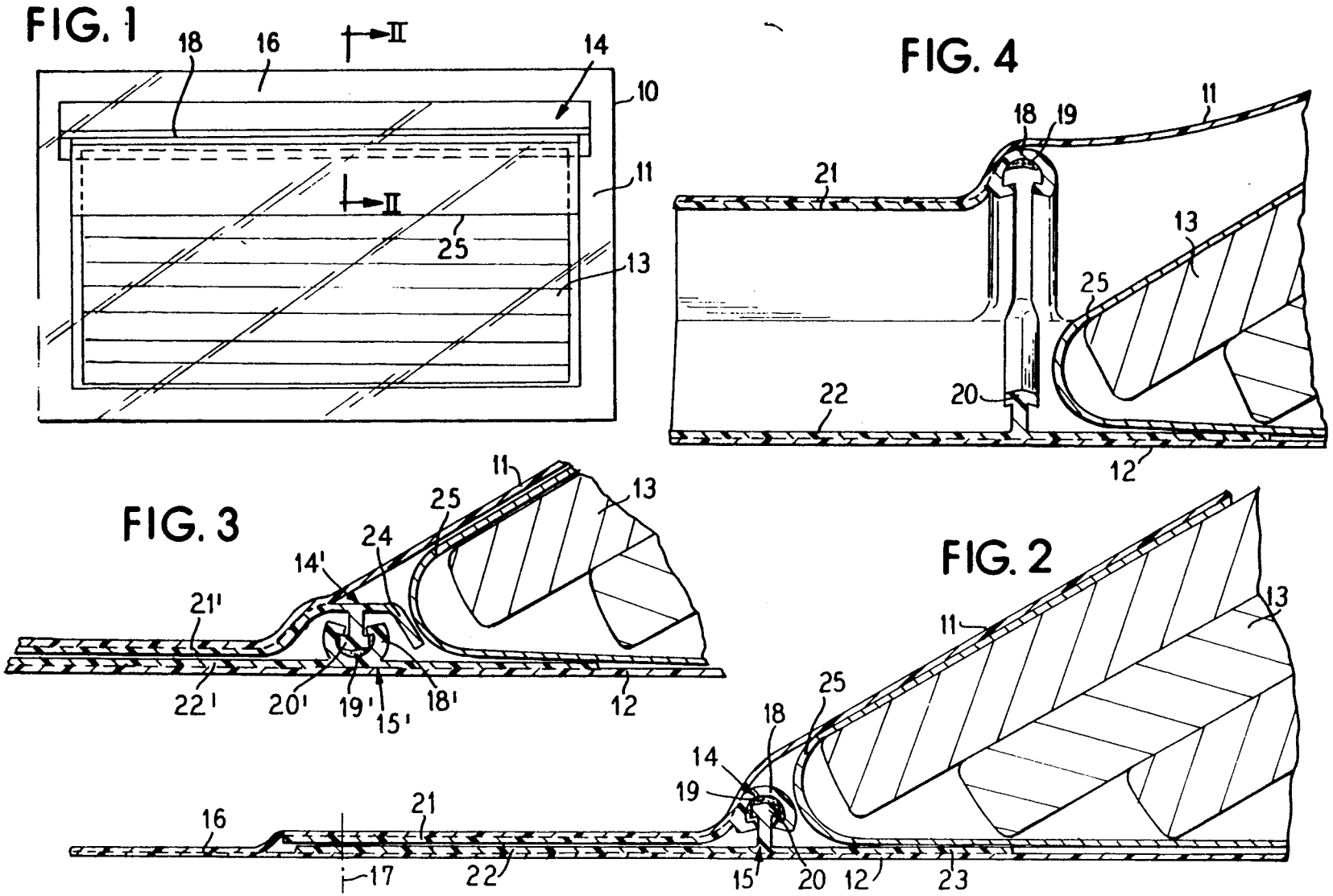
FIG. 1 is a top plan view of a bag or food package constructed in accordance with the principles of the present invention.
FIG. 2 is a vertical sectional view taken substantially along line II—II of FIG. 1.
FIG. 3 is a fragmentary view somewhat similar to FIG. 2 illustrating another form of the invention.
FIG. 4 is a fragmentary sectional view, similar to FIG. 2 but showing the opening of the bag after the edge has been cut from the bag mouth.

As illustrated in FIGS. 1 and 2, opposed layers of film 11 and 12 form bag walls which are sealed to each other around their peripheral edge 10. Along one edge is the mouth of the bag in which are located fastener strips 14 and 15. The strips may not extend fully to the side of the package as shown, but in another form will extend the full width of the film layers and the claims and practice of the invention are not to be limited to strips of any particular length.

Within the bag are the contents, such as stacked slices of bacon 13, and adjacent the bag mouth is a protector board 25 folded over the edge of bacon strips to support them and to help prevent the migration of grease to the fastener strips.

The film walls extend past the mouth of the bag to be laminated to each other at 16 thereby providing an outer seal.

Within the mouth are the strips 14 and 15 which have coacting interlocking profiles illustrated in one form by a groove 18 shaped to receive a rib 20 having a T-shape. The fastener elements are initially firmly sealed to each other in their interlocked position by a peel seal material 19 located in the base of the groove. The peel seal material, in one preferred form, is a plastic, such as a hot melt plastic, placed into the groove while warm and thereafter the head immediately inserted into the groove so that as the plastic cools, it firmly attaches the head in the groove. This provides a secure hermetic seal preventing the migration of grease out from the contents and preventing the entrance of any contaminating air from the exterior of the bag.

The fastener strips 14 and 15 are provided with base webs. The lower strip 15 has an outer base web portion 22, and the upper web has an outer web portion 21. These portions extend, unattached to each other within the film and will subsequently provide opening pull flanges. For using the bag, the operator cuts off the bag top along a cut line 17. The pull flanges can then be pulled apart breaking the rib 20 from the peel seal material 19 to open the package as illustrated in FIG. 4. Thereafter, the bag can be reclosed by pressure pressing the rib and groove element together. The peel seal material will normally remain in the base of the groove and will not interfere with the normal future operation of the rib and groove closure.

The strip 15 also has an inner base web portion 23 which extends inwardly toward the interior of the bag and is laminated to the film layer 12. This additionally stabilizes the fastener strips in the bag mouth.

FIG. 3 illustrates a modified form wherein the upper and lower film walls 11 and 12 have fastener strips 14' and 15'. For the purposes of illustration only, FIG. 3 illustrates a rib 20' as being part of an upper strip 14' and a groove 18' being part of a lower strip 15'. Peel seal material 19' is located in the base of the groove.

The primary difference between the arrangement of FIG. 3, as compared with FIG. 2, is that the upper strip has a short base web 24, which is not attached to the film layer, but which butts against the inserted board 25. This helps protect the interlocked groove 18' and rib 20' from the contents 13. The short base strip 24 also helps keep the rib and groove interlocked after the peel seal has been broken when the bag is first opened.

In the manufacture of the bag, the layers of film 11 and 12 are joined on three sides, and the fastener strips 14 and 15 are then placed in the mouth of the thus formed bag. The fastener strips may be first assembled to the film, and the lower layer of film laid on a supporting surface, the foodstuff 13 then placed on the lower layer and the edges sealed completely around the package.

When the user purchases the package from the store, he knows immediately that it is completely sealed both by the lamination of the film completely around the edge and by the rib and groove interlocked with the peel seal insuring that the rib and groove have not been separated. The user then cuts the tip off the package at 17, FIG. 2, and pulls apart the pull flaps 21 and 22. This breaks the peel seal 19 affording access to the bag contents as shown in FIG. 4. When foodstuffs are contained, such as for example, slices of bacon, the user removes what he needs and returns the remainder to the package and recloses the fastener strips by pressing together the rib and groove elements. These again provide an airtight seal giving substantial more usage and value to the package than those heretofore used where the package could not be resealed after once being opened.

I claim as my invention:

1. A flexible plastic film reclosable package for foodstuffs or the like, comprising in combination:

opposed plastic film walls joined at their edges to form a plastic bag with a bag mouth between the walls at one side;

fastener strips between the walls and the bag having reclosable pressure interlocking rib and groove profiles joined to close the bag with base webs supporting the profiles and laminated to the inner surface of the film;

peel seal means for sealing the space between the profiles and for maintaining the profiles in the interlocking relationship until the peel seal means is broken so that the bag is initially sealed against contamination, and after opening the profiles provide a reclosable bag; and a protector in the form of a loose flap extending from said rib profile and positioned with the plastic film walls between the contents and the interlocking profiles.

2. A flexible plastic film reclosable package for foodstuffs or the like, comprising in combination:

opposed plastic film walls joined at their edges to form a plastic bag with a bag mouth between the walls at the bag top;

opposed reclosable fastener means between the walls at the bag top having reclosable pressure interlocking rib and groove profiles joined to close the bag;

peel seal means for sealing the space between the profiles and for maintaining the profiles in interlocking relationship until the peel seal means is broken, said peel seal means filling the groove so as to prevent entry of gases and liquids from the bag contents between the rib and groove and initially sealing the contents of the bag against contamination entering from the bag top;

the bag walls having pull flaps extending above the profiles to form pull-apart flaps for separating the profiles;

and means joining the outer edges of said pull flaps to provide an additional seal outwardly of the profiles so that the additional seal can be severed for drawing the pull flaps apart to separate the profiles and separate the peel seal means.

3. A flexible plastic film reclosable package for foodstuffs or the like constructed in accordance with claim 2:

including a protector in the form of a loose flap positioned below the profiles and extending between the contents and the profiles so that direct contact between the profiles and contents of the bag is prevented.

4. A flexible plastic film reclosable package for foodstuffs or the like constructed in accordance with claim 2:

including a protector board folded over bag contents and located between the contents and the profiles so that the contents will not directly press against the profiles.

5. A flexible plastic film reclosable package for foodstuffs or the like constructed in accordance with claim 2:

including an inner layer within the walls with the profiles attached to the inner layer, said walls extending above the inner layer at the top with the means attaching the upper ends of the pull flaps joining the walls and the inner layers remaining unattached so that the walls and inner layer may be severed to form said pull flaps.

* * * * *